US005895365A

United States Patent [19]

Tomlinson

[11] Patent Number: 5,895,365

[45] Date of Patent: Apr. 20, 1999

[54] MASSAGING BEDREST CUSHION

[76] Inventor: Terry Tomlinson, 5318 Timber Trace, San Antonio, Tex. 78250

[21] Appl. No.: 08/988,630

[22] Filed: Dec. 11, 1997

[51] Int. Cl.[6] ..... A61H 1/00

[52] U.S. Cl. ..... 601/57; 601/58; 601/49; 297/217.3; 297/217.6; 297/149

[58] Field of Search ..... 601/46, 49, 56, 601/57, 58, 59; 297/160–1, 148, 149, 173, 174, 217.3, 217.6, 135, 157.1, 188.14

[56] References Cited

U.S. PATENT DOCUMENTS

| | | | |
|---|---|---|---|
| 137,738 | 4/1873 | Trevitt | 297/188.14 |
| 818,917 | 4/1906 | Ruger | 297/173 |
| 1,659,572 | 2/1928 | Klemm | 297/217.6 |
| 2,098,655 | 11/1937 | Lisle | 297/174 |
| 2,715,900 | 8/1955 | Posner | 601/49 |
| 3,614,085 | 10/1971 | Cunningham | 297/161 |
| 4,566,732 | 1/1986 | Ostergaard, II et al. | 297/174 |
| 4,921,302 | 5/1990 | Godwin | 297/174 |
| 5,086,769 | 2/1992 | Vianello et al. | 601/98 |
| 5,503,457 | 4/1996 | Rosado | 297/217.6 |

FOREIGN PATENT DOCUMENTS

| | | | |
|---|---|---|---|
| 5517 | 12/1881 | United Kingdom | 297/173 |

*Primary Examiner*—Richard J. Apley
*Assistant Examiner*—Benjamin K. Koo

[57] ABSTRACT

A new massaging bedrest cushion for providing a vibrating back massage as well as other conveniences. The inventive device includes a back portion having a contoured forward surface and a planar rear surface. The back portion includes a padded interior. The back portion has recesses formed in lower outer edges thereof. A plurality of vibrating transducers are disposed within the padded interior of the back portion. The transducers has an electrical cord extending outwardly therefrom for coupling with a standard electrical outlet. A first armrest is pivotally coupled with one of the recesses of the back portion. A second armrest is pivotally coupled with one of the recesses opposed from the first armrest. A control panel is disposed within an interior surface of the second armrest. The control panel is in electrical communication with the vibrating transducers.

3 Claims, 3 Drawing Sheets

MASSAGING BEDREST CUSHION

BACKGROUND OF THE INVENTION

1. Field of the Invention

The present invention relates to back massagers and more particularly pertains to a new massaging bedrest cushion for providing a vibrating back massage as well as other conveniences.

2. Description of the Prior Art

The use of back massagers is known in the prior art. More specifically, back massagers heretofore devised and utilized are known to consist basically of familiar, expected and obvious structural configurations, notwithstanding the myriad of designs encompassed by the crowded prior art which have been developed for the fulfillment of countless objectives and requirements.

Known prior art back massagers include U.S. Pat. No. 5,389,064 to Cohen; U.S. Pat. No. 4,006,739 to Wahl; U.S. Pat. Des. No. 354,876 to Pace; U.S. Pat. No. 5,297,848 to Grinnell; U.S. Pat. No. 5,288,135 to Forcier et al.; and U.S. Pat. No. 4,759,543 to Feldman.

While these devices fulfill their respective, particular objectives and requirements, the aforementioned patents do not disclose a new massaging bedrest cushion. The inventive device includes a back portion having a contoured forward surface and a planar rear surface. The back portion includes a padded interior. The back portion has recesses formed in lower outer edges thereof. A plurality of vibrating transducers are disposed within the padded interior of the back portion. The transducers has an electrical cord extending outwardly therefrom for coupling with a standard electrical outlet. A first armrest is pivotally coupled with one of the recesses of the back portion. A second armrest is pivotally coupled with one of the recesses opposed from the first armrest. A control panel is disposed within an interior surface of the second armrest. The control panel is in electrical communication with the vibrating transducers.

In these respects, the massaging bedrest cushion according to the present invention substantially departs from the conventional concepts and designs of the prior art, and in so doing provides an apparatus primarily developed for the purpose of providing a vibrating back massage as well as other conveniences.

SUMMARY OF THE INVENTION

In view of the foregoing disadvantages inherent in the known types of back massagers now present in the prior art, the present invention provides a new massaging bedrest cushion construction wherein the same can be utilized for providing a vibrating back massage as well as other conveniences.

The general purpose of the present invention, which will be described subsequently in greater detail, is to provide a new massaging bedrest cushion apparatus and method which has many of the advantages of the back massagers mentioned heretofore and many novel features that result in a new massaging bedrest cushion which is not anticipated, rendered obvious, suggested, or even implied by any of the prior art back massagers, either alone or in any combination thereof.

To attain this, the present invention generally comprises a back portion having a contoured forward surface and a planar rear surface. The back portion includes a padded interior. The back portion has recesses formed in lower outer edges thereof. A plurality of vibrating transducers are disposed within the padded interior of the back portion. The transducers has an electrical cord extending outwardly therefrom for coupling with a standard electrical outlet. A first armrest is pivotally coupled with one of the recesses of the back portion. The first armrest has a recess formed within an upper surface of a free end thereof. The first armrest has a flexible pouch secured to an interior surface thereof. A second armrest is pivotally coupled with one of the recesses opposed from the first armrest. An upper surface of the armrest has three linearly aligned apertures formed therein. A control panel is disposed within an interior surface of the second armrest. The control panel is in electrical communication with the vibrating transducers. The control panel includes a control knob having multiple settings. The control panel further includes an electrical outlet. A collapsible tray is provided having a generally rectangular configuration. The tray includes a pair of inverted L-shaped brackets. Horizontal segments of the brackets are pivotally secured to a rear surface of the tray. Vertical segments of the brackets are received within two of the three apertures of the second armrests. A light is adapted for securement to an upper edge of the collapsible tray. The light has an electrical cord adapted for coupling with the electrical outlet of the control panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new massaging bedrest cushion apparatus and method which has many of the advantages of the back massagers mentioned heretofore and many novel features that result in a new massaging bedrest cushion which is not anticipated, rendered obvious, suggested, or even implied by any of the prior art back massagers, either alone or in any combination thereof.

It is another object of the present invention to provide a new massaging bedrest cushion which may be easily and efficiently manufactured and marketed.

It is a further object of the present invention to provide a new massaging bedrest cushion which is of a durable and reliable construction.

An even further object of the present invention is to provide a new massaging bedrest cushion which is susceptible of a low cost of manufacture with regard to both materials and labor, and which accordingly is then susceptible of low prices of sale to the consuming public, thereby making such massaging bedrest cushion economically available to the buying public.

Still yet another object of the present invention is to provide a new massaging bedrest cushion which provides in the apparatuses and methods of the prior art some of the advantages thereof, while simultaneously overcoming some of the disadvantages normally associated therewith.

Still another object of the present invention is to provide a new massaging bedrest cushion for providing a vibrating back massage as well as other conveniences.

Yet another object of the present invention is to provide a new massaging bedrest cushion which includes a back portion having a contoured forward surface and a planar rear surface. The back portion includes a padded interior. The back portion has recesses formed in lower outer edges thereof. A plurality of vibrating transducers are disposed within the padded interior of the back portion. The transducers has an electrical cord extending outwardly therefrom for coupling with a standard electrical outlet. A first armrest is pivotally coupled with one of the recesses of the back portion. A second armrest is pivotally coupled with one of the recesses opposed from the first armrest. A control panel is disposed within an interior surface of the second armrest. The control panel is in electrical communication with the vibrating transducers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
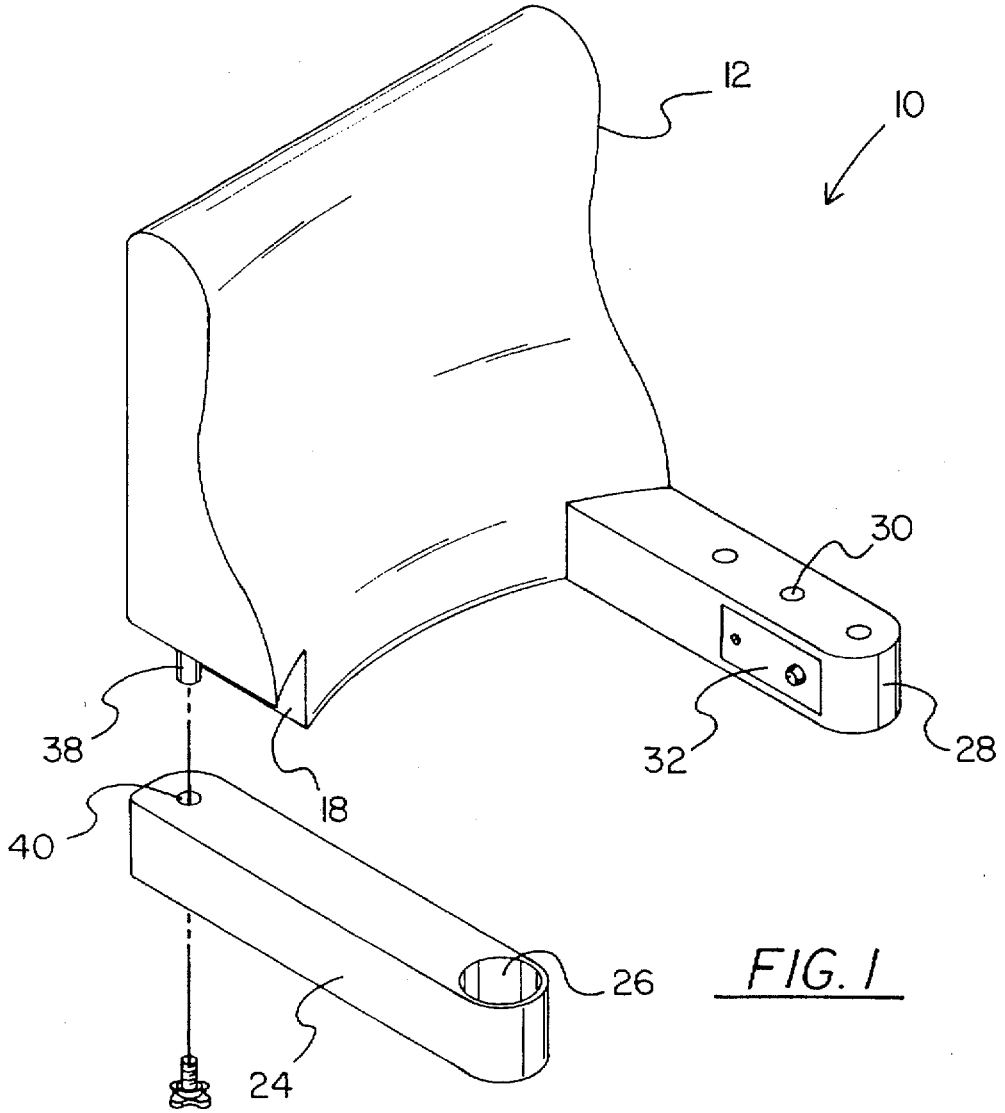
FIG. 1 is a perspective view of a new massaging bedrest cushion according to the present invention.
Figure 2:
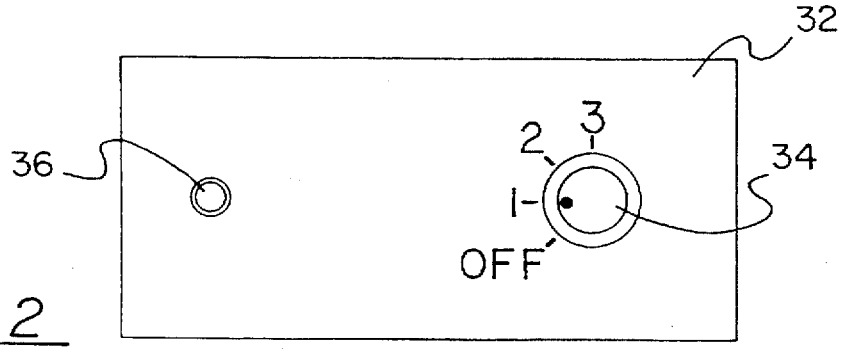
FIG. 2 is a side view of one of the armrests of the present invention.
Figure 3:
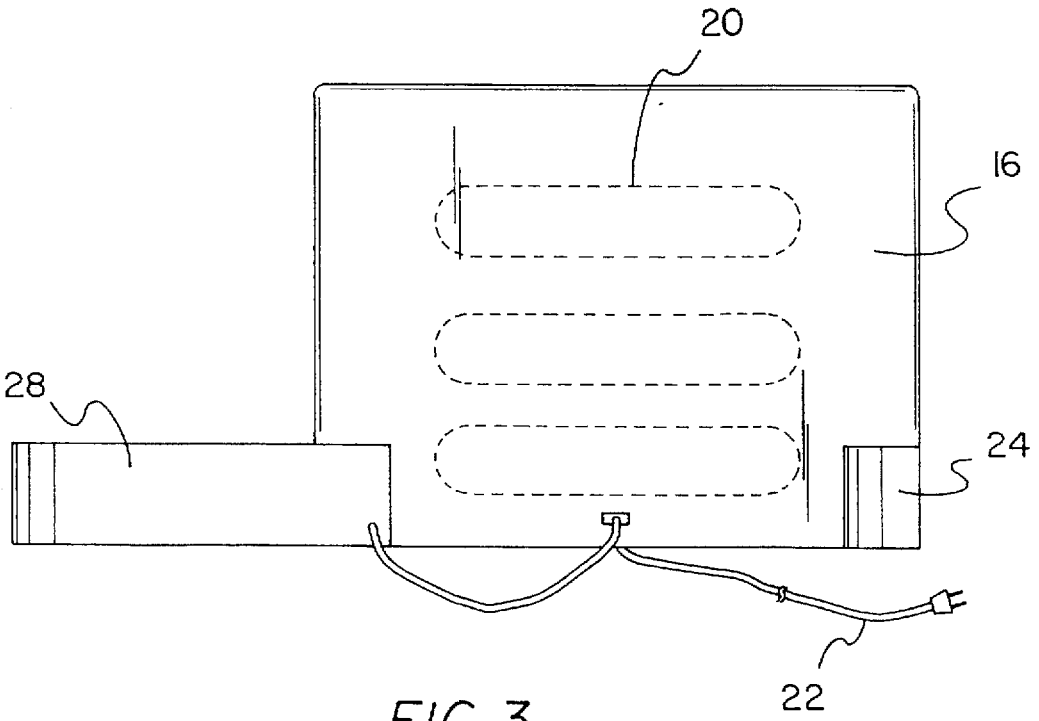
FIG. 3 is a rear elevation view of the present invention.
Figure 4:
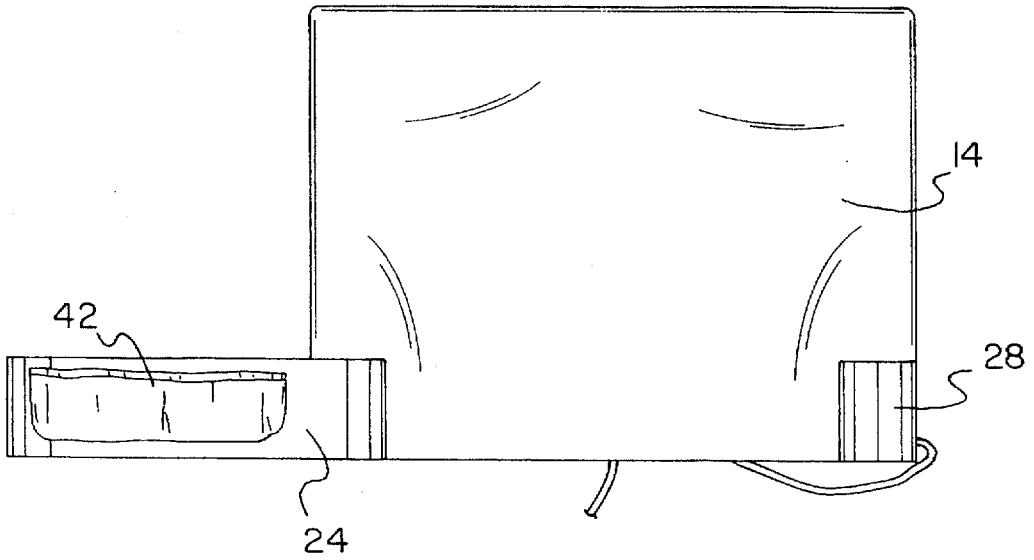
FIG. 4 is a front elevation view of the present invention.
Figure 5:
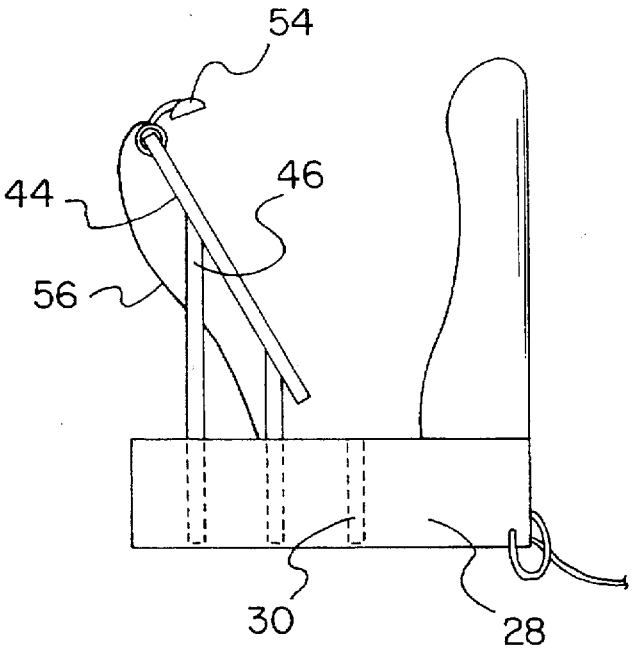
FIG. 5 is a side elevation view of the present invention with the collapsible tray attached thereto.
Figure 6:
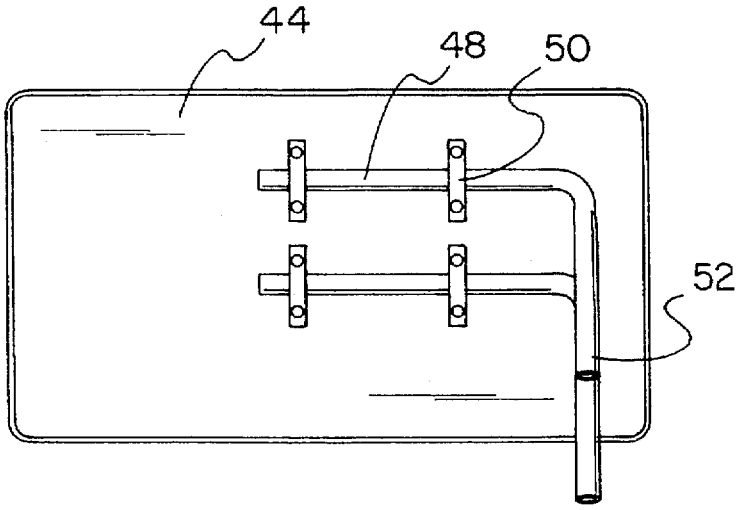
FIG. 6 is a rear view of the collapsible tray of the present invention.

With reference now to the drawings, and in particular to FIGS. 1 through 6 thereof, a new massaging bedrest cushion embodying the principles and concepts of the present invention and generally designated by the reference numeral 10 will be described.

As best illustrated in FIGS. 1 through 6, the massaging bedrest cushion 10 comprises a back portion 12 having a contoured forward surface 14 and a planar rear surface 16. The back portion 12 includes a padded interior. The back portion 12 has recesses 18 formed in lower outer edges thereof. The back portion 12 would support a person who is relaxing on a bed or sofa who wanted to sit upright to read, write, or enjoy a meal. The back portion 12 is preferably constructed of vinyl and dense urethane foam to maintain its shape better than simple cushions currently available.

A plurality of vibrating transducers 20 are disposed within the padded interior of the back portion 12. The transducers 20 has an electrical cord 22 extending outwardly therefrom for coupling with a standard electrical outlet. The transducers 20, when activated, would create a vibrating, massaging action.

A first armrest 24 is pivotally coupled with one of the recesses 18 of the back portion 12. The first armrest 24 has a recess 26 formed within an upper surface of a free end thereof. The recess 26 would act as a cup holder.

A second armrest 28 is pivotally coupled with one of the recesses 18 opposed from the first armrest 24. An upper surface of the second armrest 28 has three linearly aligned apertures 30 formed therein. A control panel 32 is disposed within an interior surface of the second armrest 28. The control panel 32 is in electrical communication with the vibrating transducers 20. The control panel 32 includes a control knob 34 having multiple settings. The control panel 32 further includes an electrical outlet 36.

The first and second armrests 24,28 are attached to the back portion 12 by means of a steel rod 38 that extends downwardly from the recesses 18. This rod 38 would fit into a machined socket 40 at the rear top surface of each armrest, creating a pivot that would make it easier to position oneself and to get in or out of bed. The armrests would have top surfaces made rigid with the use of plywood beneath the vinyl covering. Each of the armrests would have a gathered pouch-type pocket 42 with an elasticized top edge that would be nearly as long as the outside of the armrest. These pockets 42 would be well suited for storing small items that would be convenient to have within easy reach.

A collapsible tray 44 is provided having a generally rectangular configuration. The tray 44 includes a pair of inverted L-shaped brackets 46. Horizontal segments 48 of the brackets 46 are pivotally secured to a rear surface of the tray 44. The horizontal segments 48 would be attached to the rear surface of the tray 44 by two strips of aluminum 50 positioned in parallel running from top to bottom, and allowing the tray 44 to be adjusted and to collapse to a flat configuration for easy storage when not in use. Vertical segments 52 of the brackets 46 are received within two of the three apertures 30 of the second armrests 28.

A light 54 is adapted for securement to an upper edge of the collapsible tray 44. The light 54 has an electrical cord 56 adapted for coupling with the electrical outlet 36 of the control panel 32.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A massaging bedrest cushion system for providing a vibrating back massage comprising, in combination:

a bed having an upper surface;

a bedrest cushion comprising a back portion having a contoured forward surface and a planar rear surface, the back portion including a padded interior, the back portion having a lower edge resting on the upper surface of the bed, the back portion having recesses formed in lower outer edges thereof;

a plurality of horizontally oriented, vertically spaced parallel vibrating transducers disposed within the padded interior of the back portion, the transducers having an electrical cord extending outwardly therefrom for coupling with a standard electrical outlet;

a first armrest pivotally coupled with one of the recesses of the back portion, the first armrest having a recess formed within an upper surface of a free end thereof, the first armrest having an elongated gathered flexible pouch secured to an interior surface thereof;

a second armrest pivotally coupled with one of the recesses opposed from the first armrest, an upper surface of the second armrest having three linearly aligned apertures formed therein, a control panel disposed within an end of an interior surface of the second armrest, the control panel being in electrical communication with the vibrating transducers, the control panel including a control knob having multiple settings, the control panel further including a female electrical outlet;

wherein the armrests are attached to the back portion by vertically oriented rods extending downwardly from the recesses and sockets formed in a rear extent of the upper surface of the armrests such that the armrests pivot about vertical axes;

a collapsible tray having a generally rectangular configuration, the tray including a pair of inverted L-shaped brackets, wherein horizontal segments of the brackets are pivotally secured in parallel to a rear surface of the tray and vertical segments of the brackets are adapted for being selectively received within two of the three vertically oriented apertures of the second armrest for selectively angling the tray, wherein the horizontal segments are each pivotally secured to the tray with a pair of laterally extending brackets; and a light secured to an upper edge of the collapsible tray, the light having an electrical cord adapted for removably coupling with the electrical outlet of the control panel.

2. A massaging bedrest cushion for providing a vibrating back massage as well as other conveniences comprising, in combination:

a back portion having a contoured forward surface and a planar rear surface, the back portion including a padded interior, the back portion having recesses formed in lower outer edges thereof;

a plurality of vibrating transducers disposed within the padded interior of the back portion, the transducers having an electrical cord extending outwardly therefrom for coupling with a standard electrical outlet;

a first armrest pivotally coupled with one of the recesses of the back portion;

a second armrest pivotally coupled with one of the recesses opposed from the first armrest, a control panel disposed within an interior surface of the second armrest, the control panel being in electrical communication with the vibrating transducers;

wherein the armrests are attached to the back portion by vertically oriented rods extending downwardly from the recesses and sockets formed in a rear extent of an upper surface of the armrests such that the armrests pivot about vertical axes;

a collapsible tray having a generally rectangular configuration, the tray including a pair of inverted L-shaped brackets, wherein horizontal segments of the brackets are pivotally secured in parallel to a rear surface of the tray and vertical segments of the brackets are adapted for being selectively received within two of the three vertically oriented apertures of the second armrest for selectively angling the tray; and a light adapted for securement to an upper edge of the collapsible tray, the light having an electrical cord adapted for removably coupling with a female electrical outlet of the cushion.

3. The massaging bedrest cushion as set forth in claim 2 wherein the first armrest has a flexible pouch secured to an interior surface thereof.

* * * * *